US006722285B2

(12) United States Patent
Nakamura et al.

(10) Patent No.: US 6,722,285 B2
(45) Date of Patent: Apr. 20, 2004

(54) RAILWAY CAR

(75) Inventors: Hideyuki Nakamura, Yamaguchi (JP); Sumio Okuno, Yamaguchi (JP); Toshiaki Makino, Yamaguchi (JP); Toshiaki Sagawa, Yamaguchi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/229,249

(22) Filed: Aug. 28, 2002

(65) Prior Publication Data

US 2003/0056684 A1 Mar. 27, 2003

(30) Foreign Application Priority Data

Sep. 25, 2001 (JP) ..... 2001-290529

(51) Int. Cl.[7] ..... B61D 17/00
(52) U.S. Cl. ..... 105/392.5
(58) Field of Search ..... 105/392.5, 396, 105/401, 397, 402, 413, 414, 418, 417, 421, 422; 213/220, 221, 222

(56) References Cited

U.S. PATENT DOCUMENTS

| | | | | |
|---|---|---|---|---|
| 3,420,192 A | * | 1/1969 | Ellis | 105/422 |
| 5,383,406 A | * | 1/1995 | Vanolo et al. | 105/401 |
| 5,601,034 A | * | 2/1997 | Tao et al. | 105/423 |
| 5,715,757 A | * | 2/1998 | Dannawi et al. | 105/392.5 |
| 6,003,930 A | | 12/1999 | Frank et al. | |
| 6,196,135 B1 | | 3/2001 | Kashima et al. | |
| 2002/0117078 A1 | * | 8/2002 | Ina et al. | 105/413 |

FOREIGN PATENT DOCUMENTS

| | | | |
|---|---|---|---|
| EP | 0 797 043 | | 9/1997 |
| EP | 1 103 334 | | 5/2001 |
| FR | 2 698 840 | * | 6/1994 |
| JP | 7-186951 | * | 7/1995 |
| JP | 11-51103 | * | 2/1999 |

OTHER PUBLICATIONS

European Search Report mailed Feb. 11, 2003, for EP 02 25 5974.

* cited by examiner

*Primary Examiner*—Mark T. Le
(74) *Attorney, Agent, or Firm*—Antonelli, Terry, Stout & Kraus, LLP

(57) ABSTRACT

Upon forming a railway car composed of plural hollow shape members 40, annealed hollow shape members are used to form the ends of an underframe 30. The hollow shape members 40 are disposed so that their longitudinal orientation equals the longitudinal direction of the car body. The underframe 30 is formed by disposing plural hollow shape members 40 adjacent one another in the width direction and welding them together by friction stir welding. When the hollow shape members receive impact load, the ends of the members deform into concertinas, thereby absorbing the impact force. At this time, the friction stir welded portions also receive the impact force, but cracks are not created at the friction-stir-weld joints, and the weld joints do not prevent the hollow shape members from deforming into concertinas.

32 Claims, 8 Drawing Sheets

RAILWAY CAR

FIELD OF THE INVENTION

The present invention relates to a body of a railway car traveling on rails, preferably a railway car body composed of hollow shape members made of light alloy.

DESCRIPTION OF THE RELATED ART

Upon designing a railway car, one must consider how to absorb and ease the impact force loaded to the passengers on board when collision occurs. Japanese Patent Laid-Open Provisional Publication No. H7-186951 (U.S. Pat. No. 5,715,757) discloses absorbing the energy caused by the impact of the collision loaded to the front end of the leading car by the deformation thereof.

The railway car is composed of plural members being welded together. The shock absorber portion is also formed by welding plural members.

A welding method called friction stir welding is proposed as a means to weld members, which can be applied to forming railway cars. This method is disclosed in Japanese Patent No. 3014654 (EP 0797043 A2).

Japanese Patent Laid-Open Provisional Publication No. H11-51103 reports that by friction stir welding members, the metal constitution of the friction-stir-welded portion becomes refined, and the energy absorption rate is thereby improved.

According to the disclosure, friction stir welding is performed to extruded hollow shape members made of aluminum alloy in either a ring-like or spiral-like manner, the welded member being used as the steering shaft of an automobile. Friction stir welding is performed in the direction perpendicular to the direction of the impact energy, and thus the friction-stir-welded portion absorbs the impact force. Moreover, plural short pipe-shaped members are arranged linearly along the direction of impact energy, and the members are friction-stir-welded together so as to form a shaft.

Since the shock absorber portion for absorbing impact energy is mounted on the railway car body, the length of the shock absorber portion should preferably be as short as possible so as to secure enough space for the passengers. Therefore, it is desirable that a member originally included in the car body is formed as the shock absorber portion for absorbing impact energy.

The portion for absorbing impact energy is formed by joining plural members together. Therefore, the joints between the members also receive impact energy. A large amount of impact energy can be absorbed by having the shock absorber member deform into concertinas (accordion-like form). However, the welded portion is weak against impact energy, and tends to break by the impact. If the welded portion breaks, the member will no longer deform into concertinas, unable to absorb impact energy.

SUMMARY OF THE INVENTION

Thus, the present invention aims at providing a railway car body capable of absorbing impact energy.

The above object can be achieved by a railway car comprising impact energy absorption members disposed at the longitudinal ends of a car body; wherein the impact energy absorption members absorb impact energy by deforming into concertinas by the impact energy;

the impact energy absorption members are formed by welding plural members together;

the plural members are disposed along the longitudinal direction of said car body; and the plural members are welded together by friction stir welding.

DETAILED DESCRIPTION OF THE PREFERRED EMBODIMENT

Figure 1:
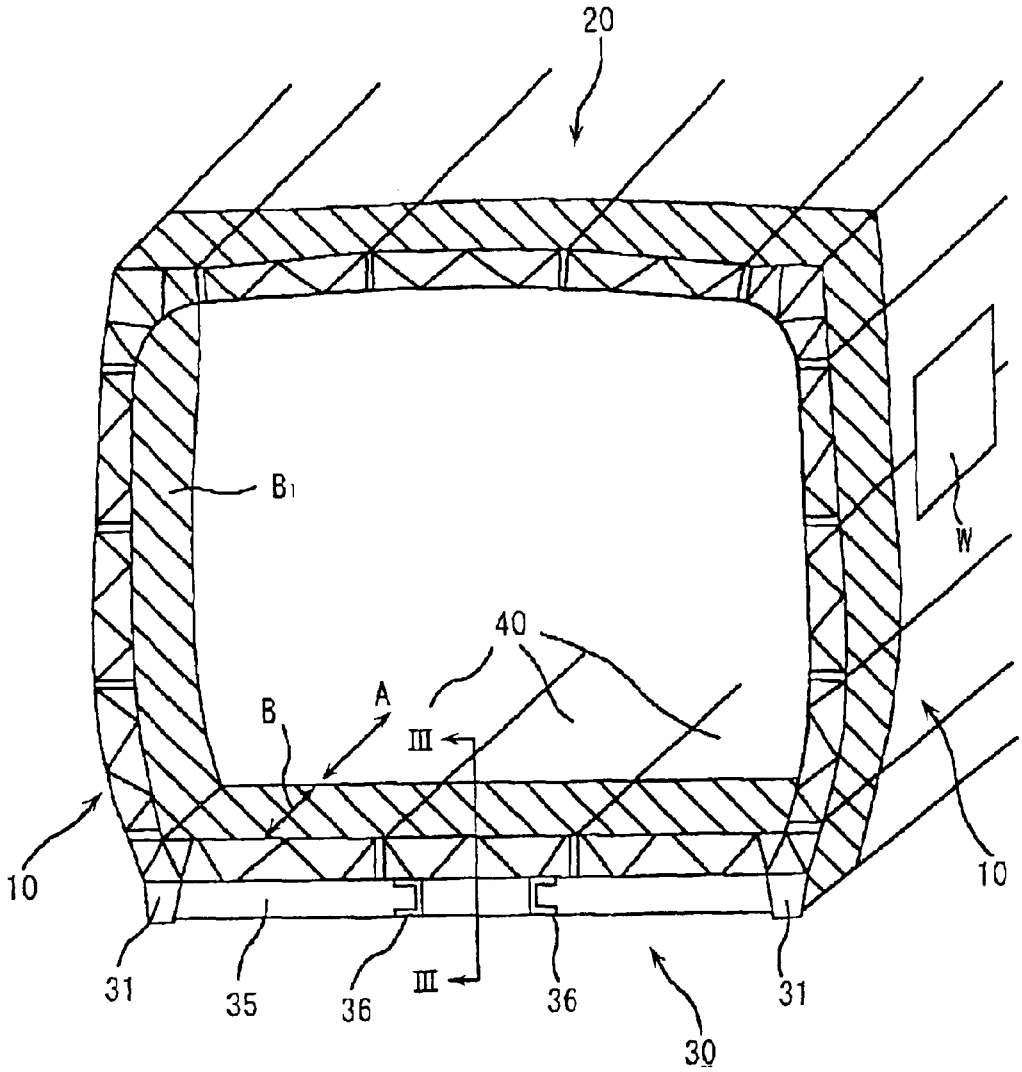
FIG. 1 is a perspective view of the end portion of a car body of a railway car according to one embodiment of the present invention.
Figure 2:
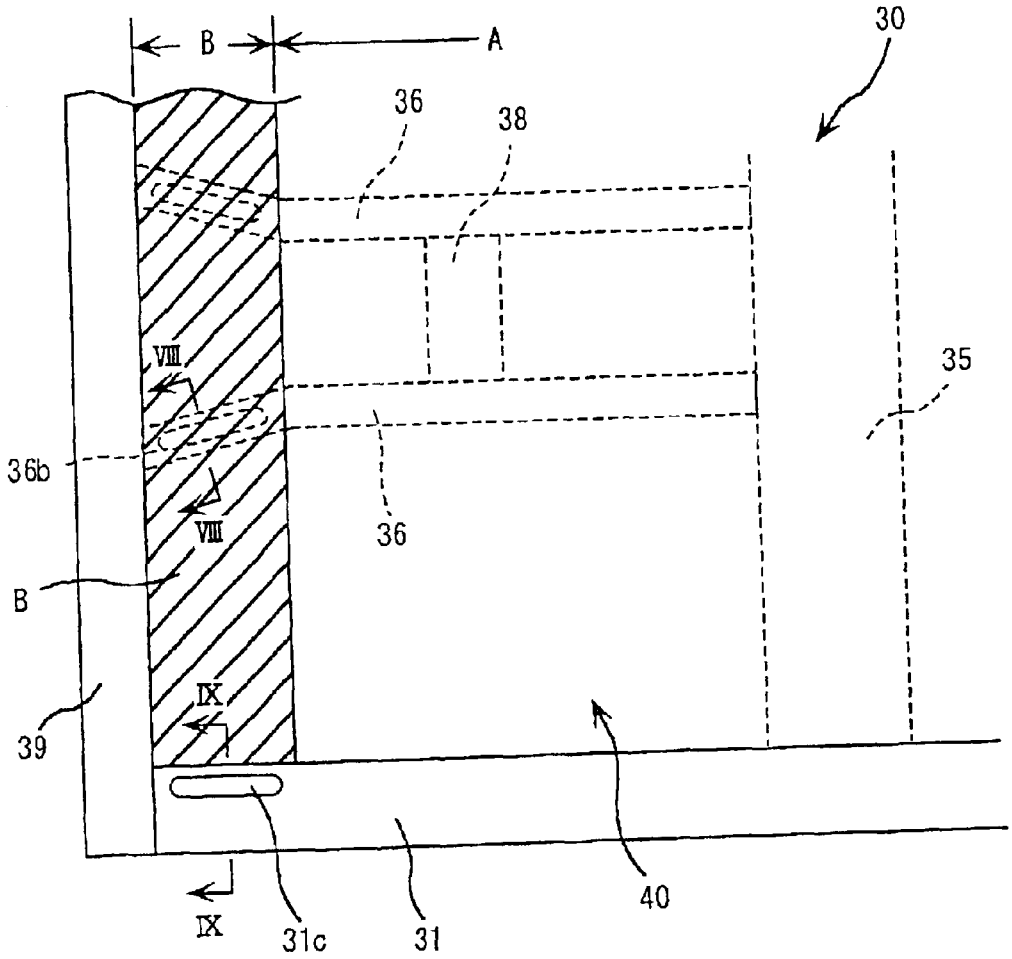
FIG. 2 is a plan view illustrating the underframe at the end portion of the car body of FIG. 1.
Figure 3:
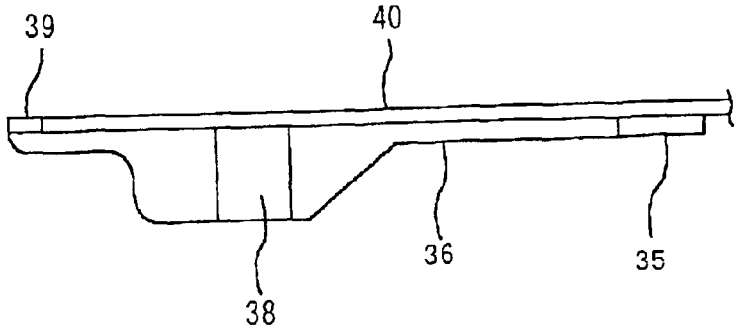
FIG. 3 is a III—III cross-sectional view of FIG. 1.

One embodiment of the present invention will now be explained with reference to FIGS. 1 through 10. FIG. 2 lacks to illustrate hollow shape members 40. However, assuming that plural hollow shape members 40 exist, the members 35, 36 and 38 disposed below the hollow shape members 40 are illustrated in dashed lines.

A car body is composed of side constructions 10, a roof construction 20, an underframe 30 that constitutes the floor thereof, and so on. The side constructions 10, the roof construction 20 and the underframe 30 are all formed by welding plural hollow shape members together. The hollow shape members are extruded shape members made of light alloy (such as aluminum alloy), and they are disposed so that the direction of extrusion thereof (that is, the longitudinal direction) is arranged along the longitudinal direction of the car body. Plural hollow shape members are arranged adjacent one another in the width direction thereof corresponding to the circumference direction of the car body, and in this state the members are welded together to form an integral structure. W denotes a window. The car body is supported by two bogies. One car body is connected to the adjacent car body by a coupler.

The underframe 30 is composed of a floor portion, side beams 31 disposed on both sides thereof, and a coupling member for connecting the coupler. The floor portion is composed of plural hollow shape members 40 disposed so that the direction of extrusion thereof is arranged in the longitudinal direction of the car body. Disposed on both width-direction sides of the floor are side beams 31 formed also of hollow shape members. Each side beam 31 is large in size and plate width, and is rigid.

Moreover, the underframe 30 comprises a coupling member disposed at both longitudinal ends on the bottom surface of the underframe for connecting the coupler used to connect car bodies together. The coupling member is composed of a bolster 35 oriented toward the width direction of the car body, two center sills 36, 36 disposed between the bolster 35 and the end of the car body, and an end beam 39 disposed at the end of the center sills 36. The two center sills 36, 36 are connected via a member 38. The center sills 36, 36 are located near the center of width of the car body. A coupler for connecting the car bodies together is mounted between the two center sills 36, 36. Since the coupler is disposed closer to the end than the member 38, the height of the center sills 36, 36 corresponding to this area is higher. These members are welded together. Both ends of the bolster 35 are welded to the side beams 31, 31. The end beam 39 is welded to the ends of plural hollow shape members 40. Both ends of the end beam 39 are welded to the side surfaces of the side beams 31, 31.

The hollow shape members B (the shaded area illustrated in FIGS. 1 and 2) constituting the both longitudinal ends of the pair of side constructions 10, the roof construction 20 and the underframe 30 composing the car body have a mechanical property different from that of the hollow shape members A constituting the center portion of the car body. The material used to form the hollow shape members B is softer than that of the hollow shape members A, which easily collapses when collision occurs, and thus composes the impact energy absorption portion. The cross-sectional shapes of hollow members A and hollow members B are the same. On both ends of the car body corresponding to the areas where the hollow shape members B are located constitutes, for example, the portion of the operator's room where the operating equipment exist (which is disposed closer to the front end than the operator's seat) or the passenger cabin of the car body (including the lavatory, restroom and crew's cabin).

The center sills 36 and the side beams 31 located at the ends of the car body where the hollow shape members B are disposed are designed to collapse easily by impact force, similar to the hollow shape members B. Within range B, long holes 36*b* are provided to the upper plates and the side plates of the center sills 36. Each center sill 36 has a channel-shaped cross-section with no bottom plate. Within range B, long holes 31*b*, 31*c*, 31*d*, 31*e* and 31*f* are provided to the face plates of the side beams 31 excluding the face plate facing the exterior side of the car body (face plate facing inner side of the car body). No long holes are provided to the exterior side of the car body so as not to deteriorate the appearance of the body. The long holes 31*e* and 31*f* exposed to the exterior of the car body can have thin plates (not shown) welded thereto so as to cover the openings of long holes. This also prevents water from entering the interior of the side beams 31.

Each hollow shape member constituting the side constructions 10, the roof construction 20 and the underframe 30 of the car body is composed of hollow shape members B, B disposed at both longitudinal ends of the member and a hollow shape member constituting the other area (center area) of the member. The length of the hollow shape member B is, for example, roughly 100 mm to 1000 mm. The hollow shape member B is softer than the hollow shape member A. The hollow shape member B is softened by annealing treatment.

The annealing can be, for example, an O-material treatment (O-material treatment: temper of annealed metal). In general, various heat treatments are performed to the extruded shape member after the extrusion. If the material of the extruded member is A6N01, an artificial aging and hardening process of T5 is performed. The annealing of the O-material is performed thereafter. The annealing treatment of the O-material is performed for two hours at 380° C., and the strength is 36.8 MPa. T5 has a strength of 245 MPa. The annealing of the O-material is meant to soften the material of the hollow shape member. The elongation of the hollow shape member B is greater than that of the hollow shape member A. The strength of the hollow shape member B is smaller than that of the hollow shape member A. In order to provide necessary strength and softness to the member, annealing other than the O-material treatment can also be performed.

Figure 4:
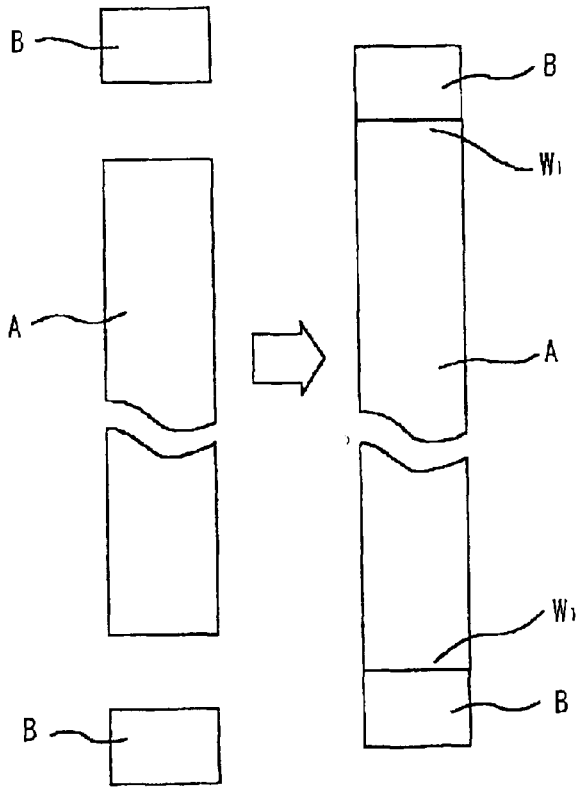
FIG. 4 is an explanatory view illustrating the method for manufacturing the hollow shape member according to one embodiment of the present invention.

The above-mentioned heat treatment can be performed after cutting the hollow shape member B to the desired length as shown in FIG. 4, or can be performed while the hollow shape member is still long (not cut). When the hollow shape member is long, the member is cut to the predetermined length (B, B) after the heat treatment.

Figure 5:
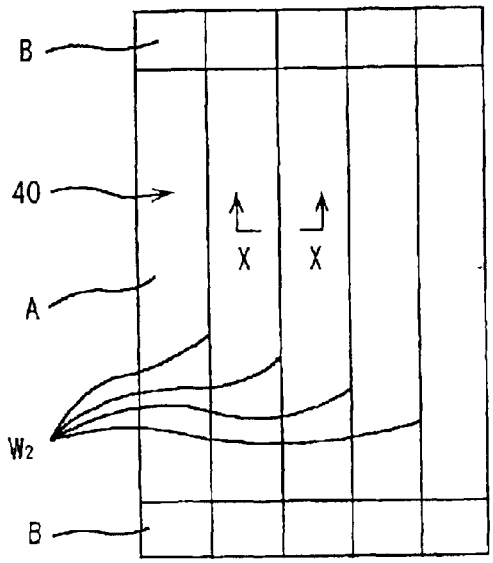
FIG. 5 is a plan view illustrating the overall structure of the underframe.

The hollow shape member A and hollow shape members B, B treated as explained above are welded together by arc welding $W_1$, to form a hollow shape member 40 having a length corresponding to the total length of the car body. The hollow shape members 40 thus manufactured are arranged side by side in the width direction (circumferential direction of the car body) as shown in FIG. 5, which are then bonded together $W_2$ by friction stir welding along the longitudinal direction of the car body, thus forming the underframe 30, the side constructions 10 and the roof construction 20. When forming the underframe 30, connecting members such as the side beams 31, 31 and the center sill 36 etc. are arc welded. The number of hollow shape members 40 illustrated in FIG. 1 is different from that illustrated in FIG. 5 since the number of members 40 in FIG. 1 is reduced so as to simplify the drawing. The underframe 30, the side constructions 10 and the roof construction 20 composed as above are welded together at end portions to form the car body.

Figure 6:
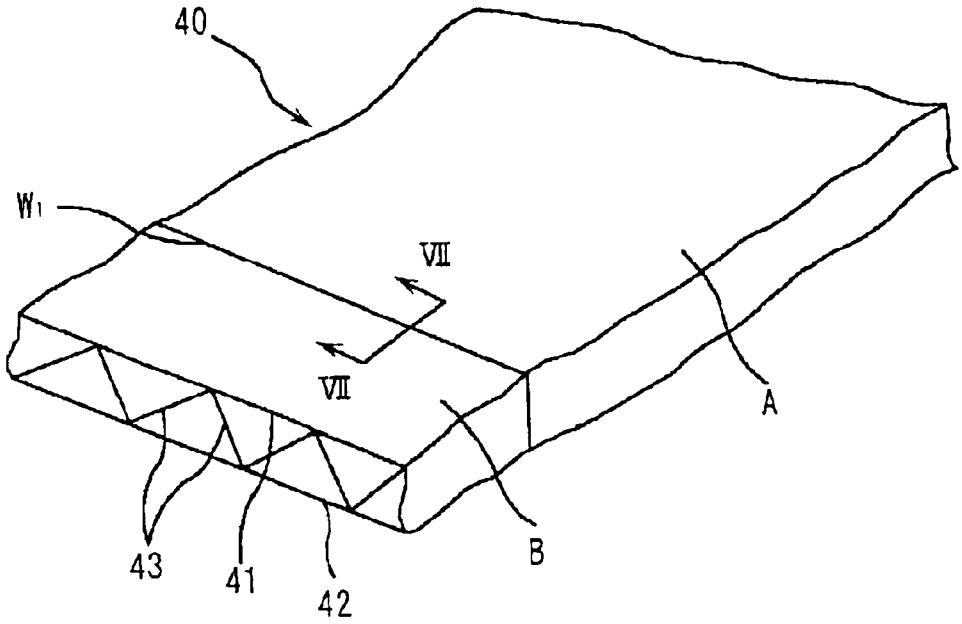
FIG. 6 is a perspective view of the end portion of the underframe according to FIG. 1.
Figure 7:
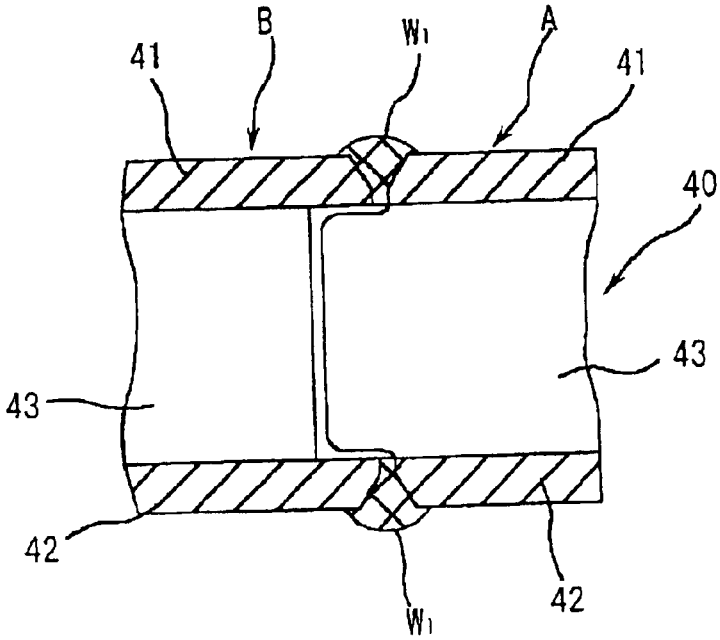
FIG. 7 is a VII—VII cross-sectional view of FIG. 6.
Figure 8:
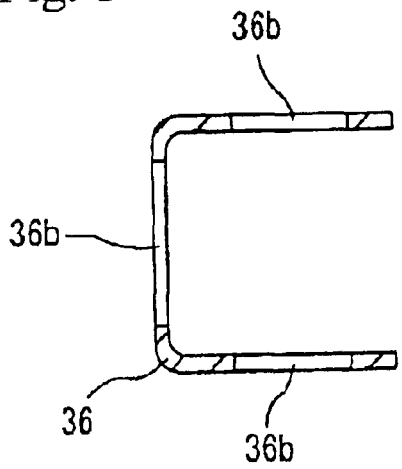
FIG. 8 is a VIII—VIII cross-sectional view of FIG. 2.

The welding structure between the hollow shape member A and hollow shape members B, B is explained with reference to FIGS. 6 and 7. As widely known, the hollow shape member 40 (A, B) comprises two face plates 41 and 42, and connecting plates 43 connecting the two face plates 41 and 42 together. The connecting plates 43 are slanted, the slanted plates 43, 43 arranged in trusses.

The ends of hollow shape members A and B are designed so that they fit into one another mutually. At the longitudinal ends of the hollow shape member A, the face plates 41 and 42 are removed by cutting so that plural slanted members (connecting plates) 43 protrude therefrom. On the other hand, the hollow shape member B is formed so that plural slanted members 43 are removed at the end region. The slanted members 43 protruding from the end of the hollow shape member A can be inserted to the space between the two face plates 41, 42 of the hollow shape member B. After the members A and B are fit together, the face plates 41 and 41 (42 and 42) are welded together from the exterior. Since the members are fit into one another before the welding, the occurrence of bend or bump at the joint is suppressed, enabling the welding procedure to be performed with ease.

The weld portion between the hollow shape member A (B) and hollow shape member A (B) disposed along the width direction of the car body is explained with reference to FIG. 10. The end portion of one hollow shape member 40 is constructed so that face plates 41 and 42 are connected by a connecting plate 45 substantially perpendicular to the face plates. A block 46 protrudes from the connecting portion between the face plate 41 (42) and connecting plate 45 toward the end. The ends of the connecting plate 45 are recessed from the outer surface of the face plates 41 and 42. The protruding block 46 is disposed at this recessed position. The face plate 41 (42) of the other hollow shape member 40 is superposed on the recessed portion. The face plates 41, 42 of the two hollow shape members are butted against each other. The end surface (the surface approaching the recessed portion) of the face plates 41 and 42 of the hollow shape member 40 comprising the connecting plate 45 is substantially on the line of extension of the center of plate thickness of the connecting plate 45. The outer surfaces of the end portions of face plates 41 and 42 of the butted hollow shape members are provided with projections 47, respectively, that protrude in the thickness direction of the hollow shape members. The projections 47 are also butted against each other.

Friction stir welding will now be explained. As illustrated in FIG. 10, one pair of hollow shape members 40, 40 are mounted on a bed 100. The projections 47, 47 disposed on the lower surface of the members are mounted on the bed 100. The butt joint portion is temporarily welded along the longitudinal direction by arc welding. At this state, the upper butt joint is friction stir welded using a rotary tool 110. The lower end of the large-diameter portion of the rotary tool 110 is disposed between the outer surface of the face plate 41 (42) and the uppermost surface of the projections 47, 47. The remaining projections can be cut and removed if necessary. After friction stir welding the upper surface, the hollow shape members 40, 40 are turned upside down, and the bottom surface is friction stir welded in a similar manner.

Figure 9:
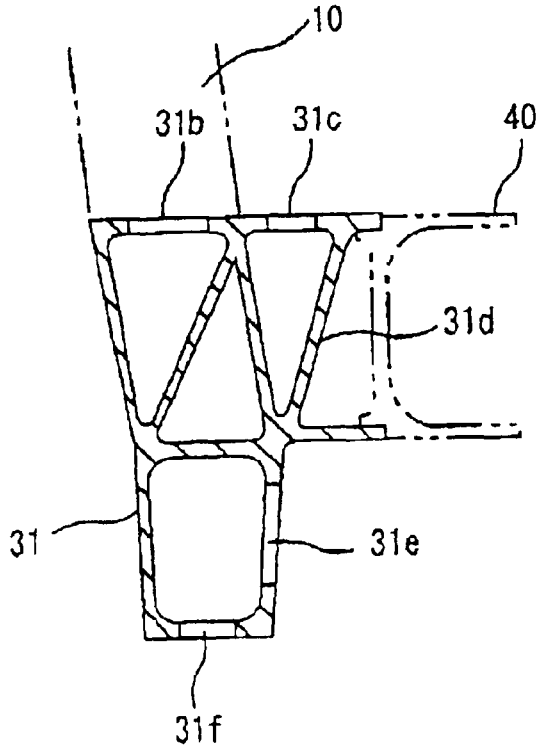
FIG. 9 is a IX—IX cross-sectional view of FIG. 2.
Figure 10:
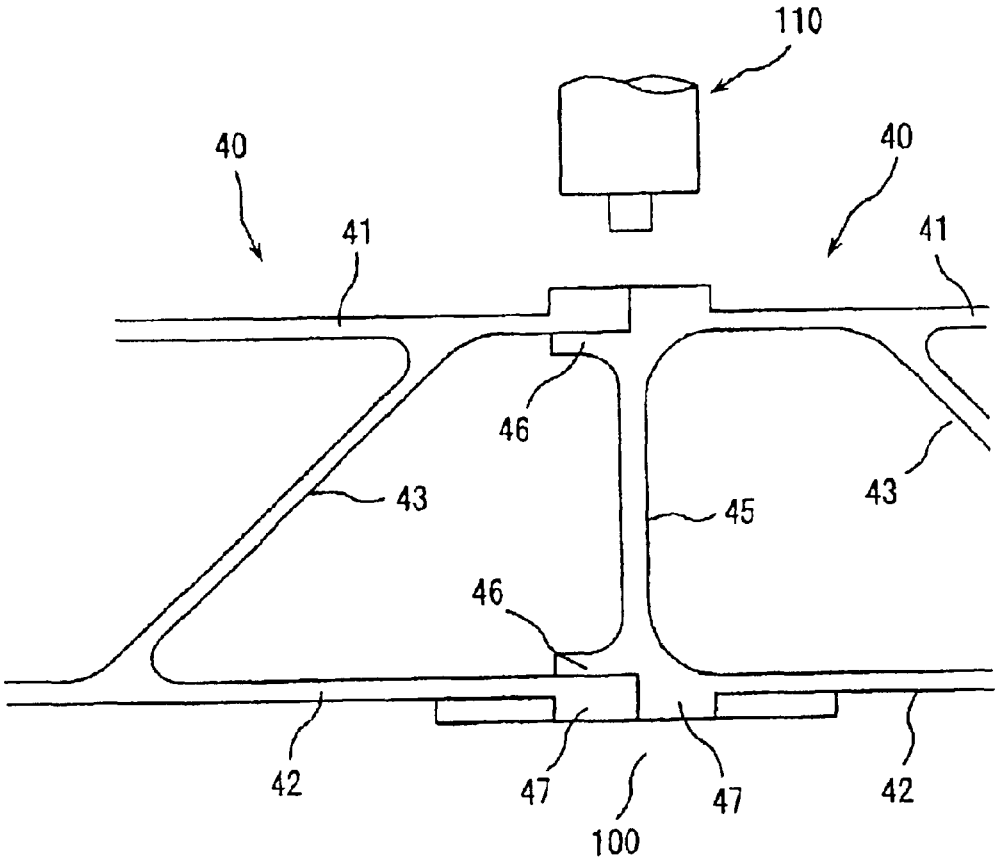
FIG. 10 is a X—X cross-sectional view of FIG. 5.

As illustrated in FIG. 9, the construction of the welding portion between the hollow shape member 40 and the side beam 31 is similarly formed as shown in FIG. 10, which is also similarly friction stir welded. In general, the side beam is welded as a portion of the underframe 30 before it is welded onto the side construction 10.

After joining the hollow shape member A and hollow shape member B by arc welding, it is preferable to perform friction stir welding.

When the railway car crashes into an obstacle, impact load is received by the hollow shape member B. The impact causes the coupler joining the car bodies together to drop off. Therefore, the end portion of one car body collides against the end portion of the adjacent car body. According to this action, impact force acts on the plural hollow shape members B, the side beams 31 and the center sills 36 from the end beam 39 of the underframe 30. Moreover, impact force acts on the ends of the side constructions 10 and the roof construction 20.

Since at the end portions of the car body are disposed hollow shape members B which are softer than the hollow shape members A disposed at the center of the car body, the hollow shape members B constituting a part of the underframe 30 deform before the deformation of the general portion constituted by hollow shape members A upon receiving impact force, thereby relieving the impact. Since the center sills 36 and the side beams 31 disposed within the range of hollow shape members B are also provided with long holes that enable them to deform easily, they will deform similarly when collision occurs, allowing the hollow shape members B constituting the underframe 30 to deform easily. Furthermore, the end portions of the side constructions 10, 10 and the roof construction 20 are also formed by the soft hollow shape members B, enabling deformation.

Figure 11:
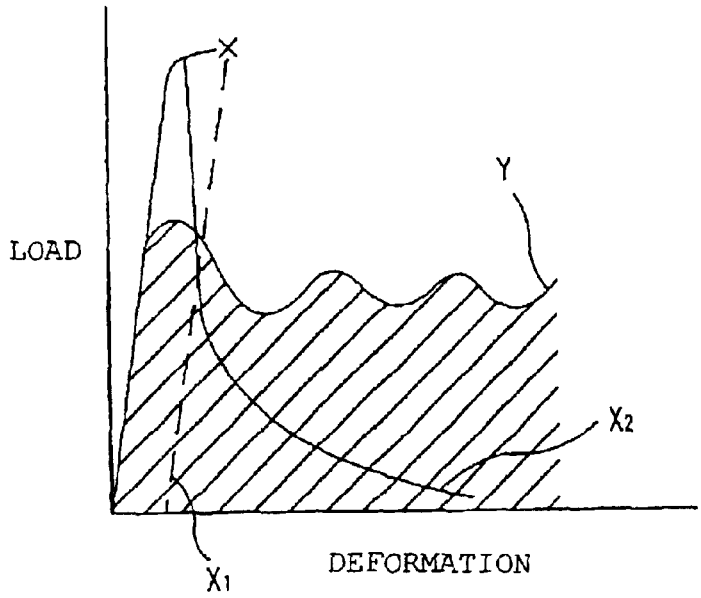
FIG. 11 is an explanatory view illustrating the impact energy of the materials.
Figure 12:
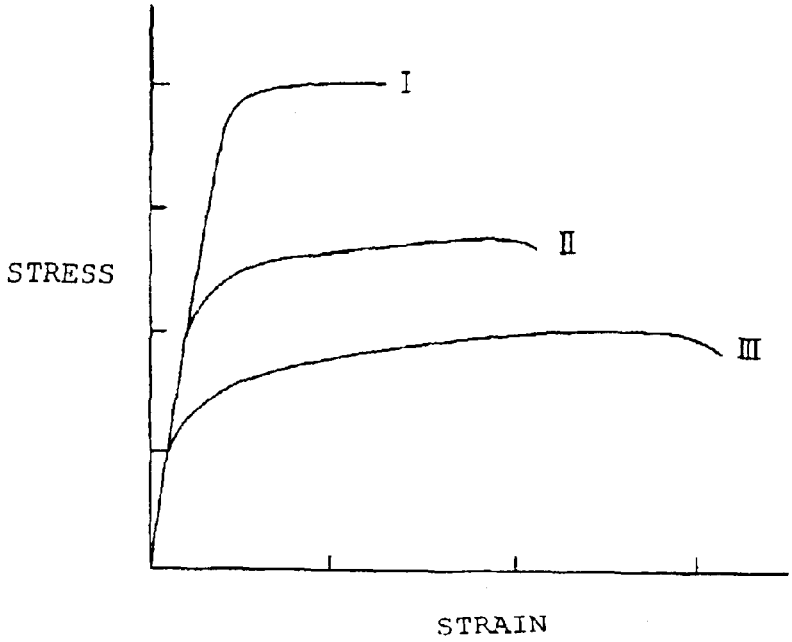
FIG. 12 is a stress-strain diagram of the materials.

We will now explain the impact-relieving characteristics of the hollow shape member B. When compressive load is applied thereto, the hollow shape member denotes a load-deformation behavior as is illustrated in FIG. 11. Three types of material are considered having different material characteristics as illustrated in FIG. 12, which are, a material I having high strength (such as pull strength and yield strength) and small elongation (brittle), a material III having less strength but better elongation, and a material II having a property intermediate those of materials I and III. The material shown by the curve X ($X_1$, $X_2$) of FIG. 11 (the material corresponding to strength property I of FIG. 12) has improved withstand load, but the withstand load drops rapidly when maximum load is exceeded. On the other hand, according to the material having low strength and high elongation (the material corresponding to strength property III of FIG. 12), the maximum withstand load is smaller but the withstand load does not drop rapidly, as illustrated by the curved line Y of FIG. 11.

The shaded area shown in FIG. 11 corresponding to curved line Y illustrates the breaking energy of this material. When comparing the X curve and the Y curve, the material having less strength but more elongation (in this case, the material of curved line Y) has higher breaking energy according to the deformation behavior after exceeding the maximum withstand load. It is important to select a material having such strength characteristic Y as the shock absorbing member B. A material having the Y-curve property can be obtained easily by providing an O-material treatment to an extruded member, for example.

In case of the curved line X, since the material has high strength and small elongation, the elongation of the member cannot correspond to the imbalance of the stress within the cross-section of the member, causing partial breaking thereof, thus causing the withstand load to drop rapidly. On the other hand, in the case of the curved line Y, the maximum withstand load of the member is smaller than that of the material of curve X, but since the material has greater elongation, partial plastic deformation of the material (elongation of the member) occurs corresponding to the dispersed stress within the cross-section of the material, thereby preventing the overall withstand load from dropping rapidly. According to this material, the member can deform greatly while maintaining a certain level of withstand load.

Therefore, when impact is added to the end portion of the car body, the hollow shape members B deform and collapse faster than the general hollow shape members A, thus relieving the shock provided to the car body. The hollow shape members B deform into concertinas. Moreover, since the members B are formed as hollow-shape members, the members have higher inner-plate and outer-plate flexural rigidity in comparison to the general thin-plate structure, and since each hollow shape member comprises a composite structure including two face plates and cross (oblique) plates, it has higher breaking-energy absorption property against compressive load (per unit planar area).

Plural hollow shape members B, B are welded together by friction stir welding along the longitudinal direction of the car body in the direction of the impact. If the welding is performed by arc welding, the weld portion may break during impact and the members can not deform into concertinas, and the energy absorption characteristics will drop. This is because according to arc welding, the impact value of the weld portion is greatly reduced than the impact value of the base material. On the other hand, the impact value of the friction-stir-welded portion is greater compared to the arc-weld portion, and the joints will not break by impact. The reason for this is considered to be that the metal constitution of the weld joint is refined by the friction stir welding, and the energy absorption value is improved. Therefore, when the hollow shape members are welded together by friction stir welding, each hollow shape member deforms in a desirable manner, absorbing the impact energy.

It is possible to soften the ends of center sills 36 and side beams 31 by heat treatment similar to that performed to hollow shape members B. In such case, the ends of the members can either be formed integrally with the center portion or be formed separately and then welded together. If they are formed of hollow shape members, the members should fit into one another as explained.

According to the above-mentioned embodiment, friction stir welding is performed from both sides of the hollow shape members, but it is also possible to weld the second face plates of the abutted members from the first face plate side of the members, and then to weld the first face plates via a connecting material, as illustrated in FIG. 9 of the above-mentioned Japanese Patent No. 3014654 (EP 0797043 A2).

Figure 13:
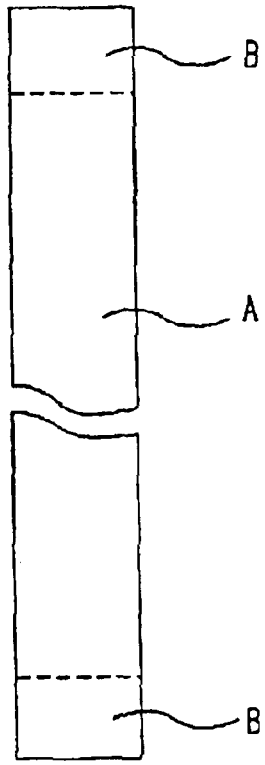
FIG. 13 is an explanatory view illustrating the method for manufacturing a hollow shape member according to another embodiment of the present invention.

The embodiment of FIG. 13 will now be explained. The hollow shape member having a length corresponding to the total length of the car body will not be cut and separated. Both ends of the long hollow shape member receive heat treatment (annealing) corresponding to the portions B, B having the predetermined lengths without being separated from the long hollow shape member. This partial heat treatment can be performed for example in a heating furnace or by providing induction hardening treatment, so as to create a hollow shape member having the desired characteristics. After creating hollow shape members having a length corresponding to the total length of the car body, plural hollow shape members are welded together to form the underframe.

According to the above-explained embodiment, the underframe, the side compositions and the roof composition have the same length, but it is also possible to have the relatively low portion of the front end of the car body of the front car protrude toward the front and forming the floor of the protrusion with the hollow shape members B. This floor constitutes the end portion of the underframe. The upper area of the floor corresponding to the protrusion can either be used as open space or operation equipment mounting space.

Figure 14:
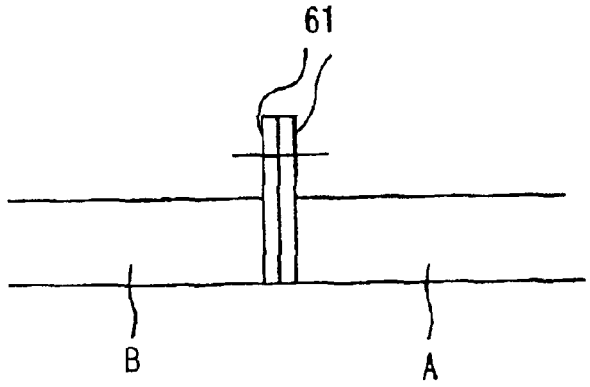
FIG. 14 is a cross-sectional view illustrating the main portion of another embodiment of the present invention.

The embodiment of FIG. 14 will now be explained. According to this embodiment, the end portion of the car body can be exchanged easily after collision. Flanges 61, 61 are provided to the ends of hollow shape members A, B by arc welding. The flanges 61 are protruded toward the inner side of the car. The flanges 61 and 61 are connected by bolts and nuts.

Furthermore, if the hollow shape members are not annealed, the desired portions of the hollow shape members can be made to deform easily upon receiving impact load by partially removing the connecting portions between the face plates and the connecting members arranged in trusses. The removal of the connecting portions can also be performed to annealed members. Even further, though according to the present embodiments the constructions of the car body are made of hollow shape members, they can also be formed of thin plates and frame members if necessary.

The technical scope of the present invention is not limited by the language used in the claims or in the summary of the present invention, but is extended for example to the range in which a person skilled in the art could easily substitute based on the present disclosure.

The present invention provides a railway car comprising at least an underframe that is formed by friction stir welding plural members disposed longitudinally along the car body, according to which the welded portions will not break when collision occurs but absorbs the impact force, thereby ensuring safety.

What is claimed is:

1. A railway car comprising impact energy absorption members disposed at longitudinal ends of a car body; wherein said impact energy absorption members absorb impact energy by deforming into concertinas by the impact energy;

said impact energy absorption members are formed by welding plural members together;

said plural members, which are extruded shape members and are softened by annealing, are disposed in the longitudinal direction of the car body; and said plural members are welded together by friction stir welding.

2. A railway car according to claim 1, wherein said impact energy absorption members constitute portions of an underframe of the car body.

3. A railway car according to claim 1, wherein said impact energy absorption members constitute the ends of an underframe, side constructions and a roof construction corresponding to the ends of the car body.

4. A railway car according to claim 1, wherein said impact energy absorption members are only disposed at longitudinal ends of the car body, and said railway car includes other members located in the longitudinal direction of the car body between said impact energy absorption members, said other members having a mechanical property different from that of the impact energy absorption members.

5. A railway car according to claim 4, wherein material used to form the impact energy absorption members is softer than that of the other members.

6. A railway car according to claim 4, wherein both the impact energy absorption members and the other members are hollow shape members.

7. A railway car according to claim 4, wherein the impact energy absorption members extend 100 mm to 1000 mm in the longitudinal direction of the car body, the other members extending a remainder of the length of the car body.

8. A railway car according to claim 4, wherein elongation of the impact energy absorption members is greater than that of the other members, and strength of the other members is greater than that of the impact energy absorption members.

9. A railway car according to claim 4, wherein ends of the impact energy absorption members are welded to ends of the other members.

10. A railway car according to claim 9, wherein the ends of the impact energy absorption members are welded to the ends of the other members by arc welding.

11. A railway car according to claim 4, wherein the ends of the impact energy absorption members and the other members are designed such that the ends of one fit into the ends of the other.

12. A railway car according to claim 4, wherein a total of lengths of the other members and the impact energy absorption members at the ends of the other members, correspond to a total length of the car body.

13. A railway car comprising impact energy absorption members disposed at longitudinal ends of a car body; wherein said impact energy absorption members absorb impact energy by deforming into concertinas by the impact energy;

said impact energy absorption members are composed of plural hollow shape members being welded together, said hollow shape members being extruded shape members and softened by annealing, the extrusion direction of said extruded shape members oriented along the longitudinal direction of the car body; and said plural hollow members are welded together by friction stir welding.

14. A railway car according to claim 13, wherein said plural hollow shape members constitute portions of an underframe of the car body.

15. A railway car according to claim 13, wherein said plural hollow shape members constitute the ends of an underframe, side constructions and a roof construction corresponding to the ends of the car body.

16. A railway car according to claim 13, wherein said impact energy absorption members are only disposed at longitudinal ends of the car body, and said railway car includes other members located in the longitudinal direction of the car body between said impact energy absorption members, said other members having a mechanical property different from that of the impact energy absorption members.

17. A railway car according to claim 16, wherein material used to form the impact energy absorption members is softer than that of the other members.

18. A railway car according to claim 16, wherein elongation of the impact energy absorption members is greater than that of the other members, and strength of the other members is greater than that of the impact energy absorption members.

19. A railway car according to claim 16, wherein ends of the impact energy absorption members are welded to ends of the other members.

20. A railway car according to claim 19, wherein the ends of the impact energy absorption members are welded to the ends of the other members by arc welding.

21. A railway car according to claim 16, wherein the ends of the impact energy absorption members and the other members are designed such that the ends of one fit into the ends of the other.

22. A railway car according to claim 16, wherein a total of lengths of the other members and the impact energy absorption members at the ends of the other members, correspond to a total length of the car body.

23. A railway car comprising impact energy absorption members disposed at longitudinal ends of a car body, and other members disposed between the impact energy absorption members in the longitudinal direction, the other members having a mechanical property different from that of the impact energy absorption members, said impact energy absorption members absorbing impact energy by deforming into concertinas by the impact energy, said impact energy absorption members being formed by welding plural members together, said plural members being disposed in the longitudinal direction of the car body, and said plural members being welded to each other by friction stir welding.

24. A railway car according to claim 23, wherein said impact energy absorption members are only disposed at the longitudinal ends of the car body.

25. A railway car according to claim 23, wherein material used to form the impact energy absorption members is softer than that of the other members.

26. A railway car according to claim 23, wherein both the impact energy absorption members and the other members are hollow shape members.

27. A railway car according to claim 23, wherein the impact energy absorption members extend 100 mm to 1000 mm in the longitudinal direction of the car body, the other members extending a remainder of the length of the car body.

28. A railway car according to claim 23, wherein elongation of the impact energy absorption members is greater than that of the other members, and strength of the other members is greater than that of the impact energy absorption members.

29. A railway car according to claim 23, wherein ends of the impact energy absorption members are welded to ends of the other members.

30. A railway car according to claim 29, wherein the ends of the impact energy absorption members are welded to the ends of the other members by arc welding.

31. A railway car according to claim 23, wherein the ends of the impact energy absorption members and the other members are designed such that the ends of one fit into the ends of the other.

32. A railway car according to claim 23, wherein a total of lengths of the other members and the impact energy absorption members at the ends of the other members, correspond to a total length of the car body.

* * * * *